United States Patent [19]

Knapp et al.

[11] Patent Number: 4,820,183

[45] Date of Patent: Apr. 11, 1989

[54] CONNECTION MECHANISM FOR CONNECTING A CABLE CONNECTOR TO A BUSHING

[75] Inventors: Todd K. Knapp, Waukesha; Harvey W. Mikulecky, Oconomowoc; Paul R. Reicher, Hubertus, all of Wis.

[73] Assignee: Cooper Power Systems, Inc., Houston, Tex.

[21] Appl. No.: 60,575

[22] Filed: Jun. 11, 1987

Related U.S. Application Data

[63] Continuation-in-part of Ser. No. 906,720, Sep. 12, 1986, abandoned.

[51] Int. Cl.[4] ..... H01R 13/62

[52] U.S. Cl. ..... 439/310; 439/921; 439/372; 439/480; 439/152

[58] Field of Search ..... 439/181–187, 439/258, 310, 476, 477, 480, 483, 484, 152, 153, 155, 157, 159, 160, 527, 529, 534, 571, 572, 574, 372, 921

[56] References Cited

U.S. PATENT DOCUMENTS

| | | | |
|---|---|---|---|
| 1,188,568 | 6/1916 | Smith | 439/310 |
| 3,307,137 | 2/1967 | Tordoff et al. | 439/281 |
| 3,918,786 | 11/1925 | Chaney et al. | 439/153 |

*Primary Examiner*—David Pirlot
*Attorney, Agent, or Firm*—James Earl Lowe, Jr.

[57] ABSTRACT

A connection mechanism for connecting and disconnecting a cable connector to a bushing mounted on an electrical apparatus comprising a saddle shroud adapted to be connected to the cable connector and having an upwardly extending extension, a plate connected to the electrical apparatus above the bushing for supporting the saddle shroud and for permitting movement of the saddle shroud relative to the bushing, the plate having a slot which receives and supports the saddle shroud extension. The connection mechanism also includes a lever mechanism for driving the connector onto and away from the bushing comprising an elongated lever including an end adapted to receive the shroud extension supported in the slot, the lever being pivotally connected spaced from the end to the supporting plate, and an arm for pivoting the lever comprising an arm connected to the elongated lever, the arm having a shotgun stick receiving end and an opening spaced from the receiving end so that, when the shroud extension is received in the lever end, the lever can be pivoted so that the cable connector is forced onto the bushing when the lever is pivoted in one direction, and the cable connector is forced away from the bushing when the lever is pivoted in the opposite direction.

13 Claims, 1 Drawing Sheet

CONNECTION MECHANISM FOR CONNECTING A CABLE CONNECTOR TO A BUSHING

REFERENCE TO RELATED CO-PENDING APPLICATION

This application is a continuation-in-part application of Knapp et al U.S. application Ser. No. 06/906,720, filed Sept. 12, 1986 and entitled "Connection Mechanism for Connecting a Cable Connector to a Bushing" now abandoned.

BACKGROUND OF THE INVENTION

This invention relates to a connection mechanism for connecting and disconnecting a cable connector to a bushing mounted on an electrical apparatus and, more particularly, to such a connection mechanism which allows a single individual to quickly connect and disconnect the cable connector and the bushing.

A cable connector, such as a visible break deadfront type T-connector, is used to connect a high voltage primary cable to a bushing on an electrical apparatus such as a transformer or padmounted switchgear. Presently, T-connectors are connected to the bushing, in most cases, by having a threaded male member within the T-connector received in a threaded female receptacle in the switchgear bushing. The threaded male member of the T-connector must be rotated by the individual making the connection. For safety reasons, this rotation of the male member is usually accomplished by rotating a hot stick connected to a tool connected to the male member.

Because one operator must use the hot stick to hold the T-connector, while another operator rotates the male member to secure the T-connector to the bushing, it is difficult to properly align the bushing and the T-connector so as to get a clean engagement of the two threaded pieces. This is also made even more difficult because the cables are quite thick and very stiff. As a result, the threaded members can become stripped. An illustration of he present or most commonly used type of connection mechanism is illustrated in Sankey et al U.S. Pat. No. 3,883,208 issued May 13, 1975, which is incorporated herein by reference.

In some other connection mechanisms, non-threaded contact members have been used and a strap connected to the switchgear face has been used to hold the cable connector to the bushing. The strap is merely slipped over the cable connector and tightened after the connector is placed on the bushing.

Examples of U.S. patents illustrating some other known connection mechanisms are:

| Patentee | U.S. Pat. No. | Issue Date |
|---|---|---|
| Hennessey, Jr. | 3,529,276 | 9/70 |
| Agron et al | 1,939,103 | 5/60 |
| Savage | 1,739,421 | 12/29 |
| Chaney et al | 3,918,786 | 11/75 |
| Ransford, III | 3,830,525 | 8/74 |
| Dennis | 4,394,549 | 7/83 |

Attention is also directed to British application No. 2,118,786 dated March, 1982.

In addition to the difficulty incurred in trying to properly align the cable connector and the bushing, the connector and bushing are usually made of elastomeric material which tends to stick when in contact for a long period of time. It is therefore often difficult for someone to separate the connector from the bushing.

SUMMARY OF THE PRESENT INVENTION

This invention provides a connection mechanism for connecting and disconnecting a cable connector to a bushing mounted on an electrical apparatus, which mechanism is easier to use than cable connectors which require the threading of one electrical contact into another. Further, the connection mechanism of this invention can be operated by a single operator because the connection mechanism assists in properly aligning the cable connector and the bushing and eliminates the need for separate connector holding and contact turning operations. Further, this connection mechanism eliminates the problem present in some prior connection mechanisms of having to have an operator supply significant force in order to break the rubber-to-rubber interface bond which can occur when the connector has been connected to the bushing for a substantial period of time.

More particularly, the connection mechanism comprises a saddle shroud adapted to be connected to the cable connector, a lever mechanism adapted to be pivotally connected adjacent the bushing to the electrical apparatus and having a notch which receives and drives the saddle shroud so that the cable connector is forced onto the bushing when the lever mechanism is pivoted in one direction and the cable connector is forced away from the bushing when the lever mechanism is pivoted in the opposite direction. The connection mechanism also includes means adapted to be connected to the electrical apparatus adjacent the bushing for receiving the lever mechanism and releasably preventing pivoting of the lever mechanism in the opposite direction after the cable connector is forced onto the bushing.

In one embodiment, the connection mechanism further includes means connected to the electrical apparatus adjacent the bushing for supporting the saddle shroud and for permitting movement of the cable connector relative to the bushing. The lever mechanism comprises an elongated lever including an end adapted to releasably receive the saddle shroud. The lever is pivotally connected spaced from the end to the shroud supporting means, and arm means is provided for pivoting the lever. The arm means comprises an arm connected to the elongated lever, the arm having a shotgun stick receiving end.

In one embodiment, the saddle shroud has an upwardly extending extension, and the shroud supporting means comprises a plate attached to the electrical apparatus above the bushing, and the plate has a slot which receives and supports the saddle shroud extension.

Other features and benefits of the invention are more particularly set forth in the attached drawings, description and appended claims.

DESCRIPTION OF THE PREFERRED EMBODIMENTS

Figure 1:
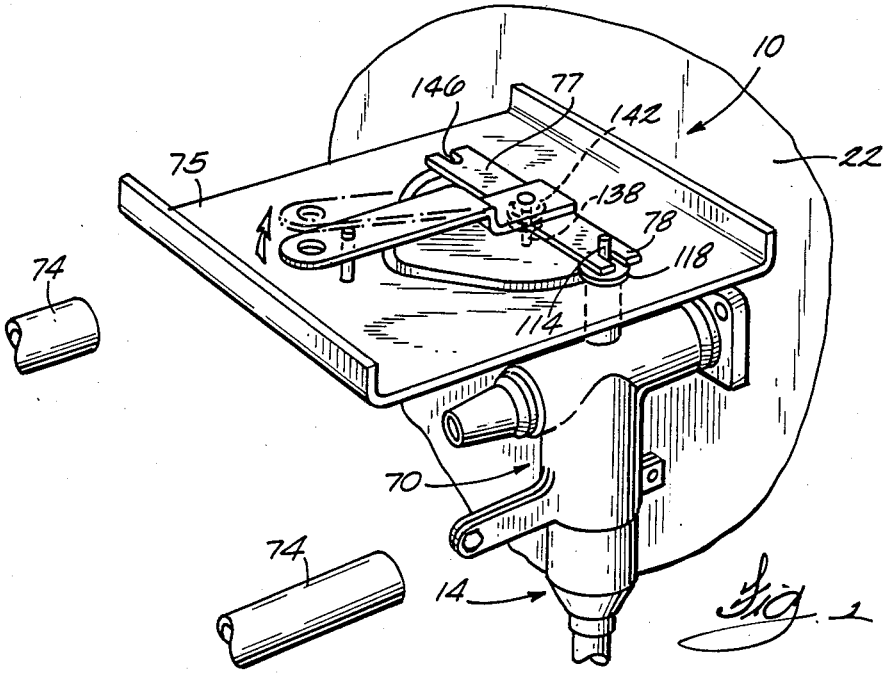
FIG. 1 is a perspective side view of a connection mechanism for connecting and disconnecting a cable connector to a bushing mounted on an electrical apparatus, which mechanism embodies various of the features of the invention.

Illustrated in the drawings is a connection mechanism 10 for connecting and disconnecting a cable connector, such as a visible break T-type connector 14, to a bushing 18 mounted on an electrical apparatus, such as pad-mounted switchgear 22. The visible break T-connector 14 is used to connect a high voltage cable 26 to the switchgear bushing 18. The switchgear bushing 18 includes a housing having an outer conical portion 30 which extends from the switchgear face 22. The conical portion 30 of the bushing 18 includes a central cylindrical passageway 38 having therein an electrical contact 40, which is connected to wiring inside the switchgear 22. The bushing 18 is supported on the face of the switchgear by a mounting plate 42.

Figure 2:
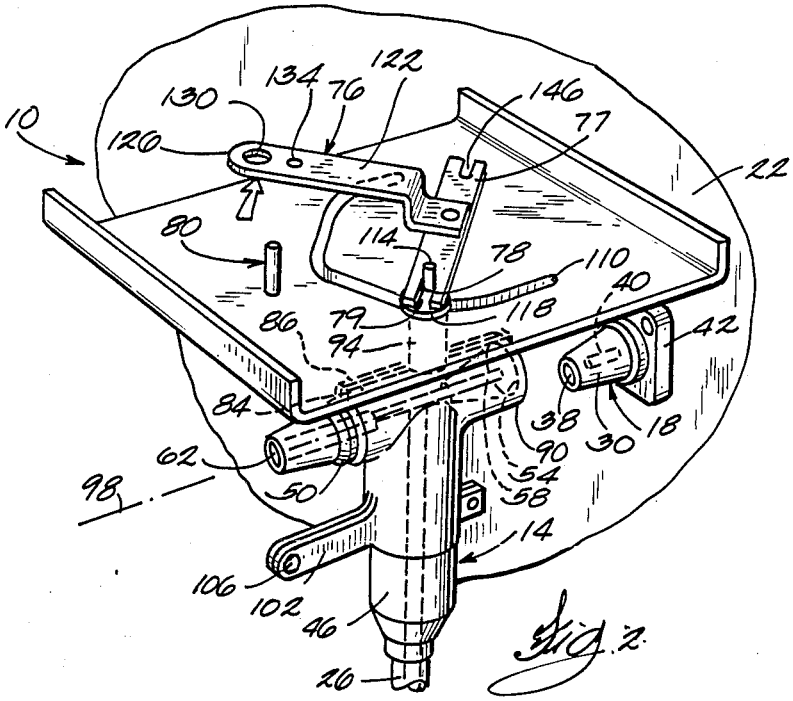
FIG. 2 is a view of the connection mechanism illustrated in FIG. 1 showing the cable connector disconnected from the bushing.

The visible break T-connector 14 includes a body having a general T-shape with a lower portion 46 housing the end of the cable 26 and an upper portion 50 having a first opening 54 (FIG. 2) which receives the conical portion 30 of the bushing 18. Mounted within the first opening 54 in the T-connector 14 is an electrical contact 58 connected to the high voltage cable 26, which contact 58 engages the contact 40 located within the bushing 18 when the conical portion 30 of the bushing 18 is received within the first opening 54 in the T-connector 14. The first opening 54 in the T-connector 14 has a conical surface which interfaces with the conical interface of the bushing 18 to provide an air tight seal between the T-connector and the bushing 18.

The T-connector upper portion 50 also includes a second opening 62 which is coaxial with the first opening 54, and which allows for insertion of a probe (not shown) into the T-connector 14 in order to determine whether the high voltage cable 26 has been de-energized.

The connection mechanism of the invention comprises a saddle shroud 70 adapted to be connected to the cable connector 14 and adapted to be movable by a shotgun stick 74, means 75 connected to the electrical apparatus 22 adjacent the bushing 18 for supporting the saddle shroud 70 and for permitting movement of the cable connector 14 relative to the bushing 18, and a lever mechanism 76 for driving the cable connector 14 onto and away from the bushing 18. The lever mechanism 76 comprises an elongated lever 77 including an end 78 with a notch 79 adapted to releasably receive the saddle shroud 70, and the lever 77 is pivotally connected spaced from the end 78 to the shroud supporting means 75 so that, when the shroud 70 is received in the lever end 78, the lever 77 can be pivoted so that the cable connector 14 is forced onto the bushing 18 when the lever 77 is pivoted in one direction, and the cable connector 14 is forced away from the bushing 18 when the lever 77 is pivoted in the opposite direction. The connection mechanism 10 also includes means 80 connected to the shroud supporting means 75 for receiving the lever mechanism 76 and releasably preventing pivoting of the lever mechanism 76 in the opposite direction after the cable connector 14 is forced onto the bushing 18.

More particularly, the saddle shroud 70 is in the form of two metal half portions 84 and 86, respectively, which, when connected to one another, generally conform to the outer shape of the T-connector 14. More particularly, the halves of the saddle shroud 70 are adapted to be placed around the T-connector 14 and connected one to the other so as to substantially cover the T-connector 14, and a barrel portion 90 of the shroud 70 includes the upper portion 50 of the connector 14 which houses the bushing receiving first opening 54. Extending radially outwardly and upwardly is an extension 94 which is engaged and supported by the supporting means 75. The cable connector 14 and bushing 18 are connectable when the connector 14 is moved relative to the bushing 18 along an axis 98 which extends through the central opening 38 in the center of the bushing 18 and the first opening 54 in the T-connector 14, and the extension 94 extends perpendicular to this axis 98 along a generally vertical line. The saddle shroud 70 further includes a handle 102 including a pull ring eye 106 in order to permit connection of the shotgun stick 74 to the saddle shroud 70.

More particularly, the shroud supporting means is in the form of a steel rack or plate 75 attached, such as by welding, to the switchgear 22 above the bushing 18. The plate 75 has a slot 110 which receives and supports the saddle shroud extension 94. More particularly, the upper portion 114 of the saddle shroud extension 94 is threaded and has received thereon a washer 118 adjustably positioned on the upper extension portion 114 by a pair of lock nuts (not shown). The washer 118 serves to secure the upper extension portion 114 in the slot 110 after the upper extension portion 114 is inserted into the slot 110. Further, the cable connector 14 and the barrel portion 90 of the shroud 70 are spaced below the support plate 75 by adjusting the position of the washer 118 on the upper portion 114 of the shroud extension 94. The spacing between the plate 75 and cable connector 14 can thus be adjusted to provide proper alignment of the cable connector 14 and the bushing 18.

The lever mechanism 76 also includes arm means for pivoting the lever 77 in the form of an arm 122 connected to the elongated lever 77, the arm 122 having a shotgun stick receiving end 126 having a pull ring eye 130. More particularly, the shotgun receiving arm 122 extends perpendicularly from the center of the elongated lever 77. The shotgun receiving arm 122 further has a lock opening 134 spaced from the receiving end 126 and the receiving and releasably preventing means is in the form of a post 80 connected to the shroud supporting plate 75. This post 80 is receivable in the lock opening 134 in the shotgun receiving arm 122 so as to secure the shroud 70 and cable connector 14 on the bushing 18.

When release of the locking mechanism 76 is desired, the shotgun receiving arm 122 can be pivoted up and then over to release the arm 122 from the locking mechanism 80.

The lever 77 is pivotally connected to the support plate 75 by means of a bolt 138 attached to the plate 75 and received in an opening in the lever 77 and a heavy duty spring 142 on the bolt 138 and located between the lever 77 and the support plate 75. The heavy duty spring 142 allows for tilting movement of the lever 77 and the shotgun stick receiving arm 122 to permit locking and unlocking of the arm 122 on the locking post 80.

The slot 110 in the support plate 75 is generally U-shaped and the notch 79 in the end 78 of the lever 77 which receives the shroud extension 94 is sufficiently long so that, as the extension 94 and saddle shroud 70 and cable connector 14 are pivoted toward and away from the bushing 18, the cable connector 14 travels in essentially a straight path. By providing the slot 110 in a U-shape, the saddle shroud 70 and cable connector 14 can be pivoted away from the bushing 18, and then moved by connecting the shotgun stick 74 to the handle 102 to essentially the bottom of the U-shaped slot 110, i.e., the central portion of the supporting plate 75. By providing a second notch 146 in the other end of the lever 77, the lever 77 can then be pivoted so that the extension 94 is received in the second notch 146 so that the cable connector 14 can be moved to beside the bushing 18 where a standoff bushing (not shown) can be provided for holding the cable connector 14 when the cable connector 14 is not connected to the bushing 18.

The connection mechanism 10 thus can be operated by a single operator who uses a shotgun stick 74 placed on the receiving end 126 of the pivot arm 122 in order to provide the leverage necessary to pivot the lever 77 to drive the cable connector 14 onto the bushing 18 or away from the bushing 18. The use of this substantial leverage easily provides the force necessary to separate a cable connector 14 from a bushing 18 which has been in place for a long period of time. Further, by being able to adjust the spacing of the cable connector 14 from the supporting plate 75, manufacturing tolerances and any assembly tolerances occasioned by a lineman's installation in the field of the plate 75 on the electrical apparatus 22 can be easily corrected. Further, the steel plate 75 prevents the cable 26 and cable connector 14 from shifting up or down due to frost heaving, cable shifting or other unknown effects on the cable and electrical apparatus mounting pad (not shown).

Various of the features of the invention are set forth in the following claims.

We claim:

1. A connection mechanism for connecting and disconnecting a cable connector to a bushing mounted on an electrical apparatus, said mechanism comprising a saddle shroud adapted to be connected to the cable connector, means connected to the electrical apparatus adjacent the bushing for supporting said saddle shroud and for permitting movement of the cable connector relative to the bushing, a lever mechanism for driving the cable connector onto and away from the bushing, said lever mechanism comprising:

an elongated lever including an end adapted to receive said saddle shroud, said lever being pivotally connected spaced from said end to said shroud supporting means so that, when said shroud is received in said lever end, said lever can be pivoted so that the cable connector is forced onto the bushing when said lever is pivoted in one direction, and the cable connector is forced away from the bushing when said lever is pivoted in the opposite direction, and arm means for pivoting said lever, said arm means comprising an arm connected to said elongated lever at a fixed angle relative to the lever at the point of pivotal connection of said lever to said shroud supporting means, said arm having a shotgun stick receiving end, and means connected to said shroud supporting means for receiving said lever mechanism and releasably preventing pivoting of said lever mechanism in said opposite direction after the cable connector is forced onto the bushing.

2. A connection mechanism in accordance with claim 1 wherein said shotgun receiving arm has an opening spaced from said receiving end, and wherein said receiving and releasably preventing means comprises a post connected to said shroud supporting means, said post being received in said opening in the shotgun stick receiving arm when said shotgun stick receiving arm is pivoted up, over, and down onto said post.

3. A connection mechanism in accordance with claim 1 wherein the cable connector is spaced from said shroud supporting means and wherein said shroud supporting means further includes means for varying the amount the cable connector is spaced from the shroud supporting means in a direction perpendicular to the direction of movement of said saddle shroud relative to the bushing.

4. A connection mechanism in accordance with claim 1 wherein said saddle shroud has an upwardly extending extension, and wherein said shroud supporting means comprise a plate attached to the electrical apparatus above the bushing, said plate having a slot which receives and supports said saddle shroud extension.

5. A connection mechanism in accordance with claim 4 wherein said slot is generally U-shaped.

6. A connection mechanism in accordance with claim 3 wherein said saddle shroud includes an upper portion, and wherein said means for varying the amount the cable connector is spaced from said shroud supporting means comprises a washer adjustably positioned on said upper portion of said saddle shroud.

7. A connection mechanism for connecting and disconnecting a cable connector to a bushing mounted on an electrical apparatus, said mechanism comprising:

a saddle shroud adapted to be connected to the cable connector and having an upwardly extending extension, means connected to the electrical apparatus adjacent the bushing for supporting said saddle shroud and for permitting movement of the cable connector relative to the bushing, said means comprising a plate attached to the electrical apparatus above the bushing, said plate having a slot which receives and supports said saddle shroud extension, a lever mechanism for driving the connector onto and away from the bushing, said lever mechanism comprising:

an elongated lever including an end adapted to releasably receive said shroud extension supported in said slot, said lever being pivotally connected spaced from said end to said shroud supporting means, and arm means for pivoting said lever, said arm means comprising an arm connected to said elongated lever, said arm having a shotgun stick receiving end and an opening spaced from said receiving end so that, when said shroud extension is received in said lever end, said lever can be pivoted so that the cable connector is forced onto the bushing when said lever is pivoted in one direction, and the cable connector is forced away from the bushing when said said lever is pivoted in the opposite direction, and means connected to the shroud supporting means for receiving the lever mechanism and releasably preventing pivoting of the lever mechanism in said opposite direction after the cable connector is forced onto the bushing, said receiving and releasably preventing means comprising a post connected to said shroud supporting plate, said post being received in said opening in the shotgun stick receiving arm when said shotgun stick receiving arm is pivoted up, over and down onto said post.

8. A connector mechanism in accordance with claim 7 wherein said shotgun stick receiving arm extends perpendicularly from said elongated lever.

9. A connection mechanism in accordance with claim 7, wherein said slot is generally U-shaped.

10. A connection mechanism in accordance with claim 7 wherein the cable connector is spaced from said shroud supporting means and wherein said shroud supporting means further includes means for varying the amount the cable connector is spaced from the shroud supporting means in a direction perpendicular to the direction of movement of said saddle shroud relative to the bushing.

11. A connection mechanism in accordance with claim 7 wherein said elongated lever includes a second end adapted to receive said saddle shroud extension.

12. A connection mechanism for connecting and disconnecting a cable connector to a bushing mounted on an electrical apparatus, said mechanism comprising a saddle shroud adapted to be connected to the cable connector, means connected to the electrical apparatus adjacent the bushing for supporting said saddle shroud and for permitting movement of the cable connector relative to the bushing, wherein the cable connector is spaced from said shroud supporting means, and said shroud supporting means includes means for varying the amount the cable connector is spaced from said shroud supporting means in a direction perpendicular to the direction of movement of said saddle shroud relative to the bushing, and a lever mechanism adapted to be connected adjacent the bushing to the electrical apparatus, pivotable about an axis parallel to the direction of said space varying means, and having a notch which receives and drives said saddle shroud so that the cable connector is forced onto the bushing when said lever mechanism is pivoted in one direction and the cable connector is forced away from the bushing when said lever mechanism is pivoted in the opposite direction, and means adapted to be connected to the electrical apparatus adjacent the bushing for receiving said lever mechanism and releasably preventing pivoting of said lever mechanism in said opposite direction after the cable connector is forced onto the bushing.

13. A connection mechanism for connecting and disconnecting a cable connector to a bushing mounted on an electrical apparatus, said mechanism comprising a saddle shroud adapted to be connected to the cable connector and including an upper portion, means connected to the electrical apparatus adjacent the bushing for supporting said saddle shroud and for permitting movement of the cable connector relative to the bushing, wherein the cable connector is spaced from said shroud supporting means, and said shroud supporting means includes means for varying the amount the cable connector is spaced from said shroud supporting means in a direction perpendicular to the direction of movement of said saddle shroud relative to the bushing, said means for varying the amount the cable connector is spaced form said shroud supporting means comprising a washer adjustably positioned on said upper portion of said saddle shroud, and a lever mechanism adapted to be pivotally connected adjacent the bushing to the electrical apparatus, and having a notch which receives and drives said saddle shroud so that the cable connector is forced onto the bushing when said lever mechanism is pivoted in one direction and the cable connector is forced away from the bushing when said lever mechanism is pivoted in the opposite direction, and means adapted to be connected to the electrical apparatus adjacent the bushing for receiving said lever mechanism and releasably preventing pivoting of said lever mechanism in said opposite direction after the cable connector is forced onto the bushing.

* * * * *